US007281933B1

(12) United States Patent
Shigeta et al.

(10) Patent No.: US 7,281,933 B1
(45) Date of Patent: Oct. 16, 2007

(54) LEVER FITTING TYPE CONNECTOR

(75) Inventors: Yoshinori Shigeta, Shizuoka-ken (JP); Hiroaki Yamagishi, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/638,366

(22) Filed: Dec. 14, 2006

(30) Foreign Application Priority Data

Jan. 17, 2006 (JP) ..... 2006-009236

(51) Int. Cl.
*H01R 13/62* (2006.01)

(52) U.S. Cl. ..... 439/157; 439/376; 439/341

(58) Field of Classification Search ..... 439/157, 439/376, 341

See application file for complete search history.

(56) References Cited

U.S. PATENT DOCUMENTS 5,326,279 A * 7/1994 Sumida ..... 439/540.1
6,413,105 B2 * 7/2002 Noro et al. ..... 439/157
7,052,293 B2 * 5/2006 Koshy et al. ..... 439/157

FOREIGN PATENT DOCUMENTS

JP 2005-122942 5/2005

* cited by examiner

*Primary Examiner*—Truc Nguyen
(74) *Attorney, Agent, or Firm*—Finnegan, Henderson, Farabow, Garrett & Dunner, L.L.P.

(57) ABSTRACT

A lever fitting type connector includes a male connector having a male hood, a female connector having a connector main body fitted into the male hood and having a female hood which covers the male hood, and a lever which is rotatably provided inside of the female hood, and which fits or separates the male connector into or from the female connector. The lever includes a lateral plate which is rotatably engaged with a boss projecting from an inner surface of the female hood. The lateral plate is provided with a drive part far from the fulcrum of the lever in a thickness range of the lateral plate. An outer surface of the male hood is provided with an engagement projection. When the connectors are fitted to each other, these engagement projections engage the drive part of the lever to transmit a fitting force and a separating force generated by turn of the lever to the male connector.

3 Claims, 15 Drawing Sheets

LEVER FITTING TYPE CONNECTOR

BACKGROUND OF THE INVENTION

The present invention relates to a lever fitting type connector capable of fitting and separating male and female connectors to and from each other with a small force by a turning operation of a lever.

One of conventional lever fitting type connectors is disclosed in Japanese Patent Application Laid-open No. 2005-122942. This conventional lever fitting type connector mainly includes a female connector having a hood portion, a male connector having a male connector main body which is fitted into the hood portion, and a lever which is rotatably provided on the male connector for fitting and separating the male connector and the female connector to and from each other by turning the lever. The male connector main body is formed on its outer periphery with a waterproof hood. When both of the connectors are fitted to each other, the waterproof hood covers the hood portion of the female connector. A shaft for holding the lever is provided on an outer side surface of the waterproof hood. The lever is provided with a long hole into which the shaft is inserted, and a projection which penetrates the waterproof hood of the male connector and projects toward the male connector main body. To retain the projection, the fitting hood portion of the female connector is provided with a fitting projection and a separating projection.

SUMMARY OF THE INVENTION

FIGS. 1 to 7 show one example of the lever fitting type connector. This connector includes a female connector 200 having a fitting hood 201, a male connector 110 having a male connector main body 110A which is fitted into the fitting hood 201, a lever 130 which is rotatably provided on the male connector 110 for fitting and separating the male connector 110 and the female connector 200 to and from each other by turning the lever 130, a seal member (not shown) which is provided between the male connector 110 and the fitting hood 201 for sealing therebetween, and a waterproof hood 111 which is provided on the side of an outer periphery of the male connector main body 110A, and which covers the fitting hood 201 in a state where the male connector main body 110A is fitted into the fitting hood 201.

Bosses 112 and 113 projecting from an outer side surface of the waterproof hood 111 are fitted into holes 132 and 133 formed in lateral plates 131 of the lever 130, so that the lever 130 can turn in a plane which is in parallel to a fitting direction of the connectors and can slide in a direction intersecting with the fitting direction of the connectors. Inner surfaces of the pair of lateral plates 131 of the lever 130 are provided with projections 136 such as to penetrate the waterproof hood 111 and project toward the male connector main body 110A. Other projections 202 and 203 are provided on the fitting hood 201 of the female connector 200 to engage with the projection 136.

The lateral plates 131 of the lever 130 are provided with arms 138. As shown in FIG. 4, the arms 138 is temporally retained on a groove 118 provided on an outer surface of the waterproof hood 111 before the connectors are fitted to each other. This temporarily retained state is released when the arms 138 ride on a projection 205 provided on the fitting hood 201 of the female connector 200 at an initial stage where the connectors 110 and 200 are fitted to each other.

The lever 130 and the fitting hood 201 of the female connector 200 are provided with lock means 139 and 209 for locking the lever 130 in a state where the lever 130 is turned and the connectors are fitted to each other.

An operation thereof will be explained next.

Before the male and female connectors 110 and 200 are fitted to each other, the lever 130 is held at the temporarily retained position as shown in FIG. 4. In order to fit the male and female connectors 110 and 200 from this state, the male connector 110 and the female connector 200 are opposed to each other, and the male connector main body 110A is inserted into the fitting hood 201 of the female connector 200. In this state, the temporarily retained state is released and the lever 130 can turn.

A force is then applied to an operating unit of the lever 130 to turn. With this configuration, the lever 130 is guided by engagement between the bosses 112 and 113 and the holes 132 and 133, and the lever 130 slides in a direction intersecting with the fitting direction between the connectors, i.e., in a longitudinal direction of the male connector 110. As shown in FIG. 5, the projection 136 of the lever 130 enters between the two projections 202 and 203 on the side of the female connector 200.

If the lever 130 is turned, as shown in FIGS. 6 and 7, the projection 136 and the projection 202 are engaged with each other, the fitting force by the lever 130 is transmitted from the projection 202 to the female connector 200 by the effect of the lever, and the male connector 110 and the female connector 200 are fitted to each other. In the fitting state of the connectors, the lever 130 is turned to the final position, the lock means 139 and 209 are engaged with each other and the lever 130 is locked.

Meanwhile, to release the fitting state between the male and female connectors 110 and 200, the lever 130 is unlocked, and the lever 130 is turned in the opposite direction. With this configuration, the projection 136 of the lever 130 engages the projection 203 on the side of the female connector 200, the lever 130 is further turned, the separating force by the lever 130 is transmitted from the projection 203 to the female connector 200 by the effect of the lever, and the male connector 110 and the female connector 200 are separated from each other. If the lever 130 is further turned, the lever 130 is slid and returned to the initial position guided by the bosses 112 and 113 and the holes 132 and 133, and finally the lever 130 is temporarily retained.

In the lever fitting type connector, the lever 130 is rotatably provided on the outer surface of the waterproof hood 111, and the projection 136 which penetrates the waterproof hood 111 projects from the inner side surface of the lateral plate 131 of the lever 130. Therefore, the position of the fulcrum of the lever 130 and the position of the projection 136 are deviated in a thickness direction of the lateral plate 131 of the lever 130. That is, the projection 136 does not exist in a plane of the lateral plate 131 of the lever 130.

For this reason, when the lever 130 is turned and a force is transmitted to the mating side projections 202 and 203, a stress in a twisting direction is generated in the lever 130, and there is a problem that the lever 130 is prone to come out from the bosses 112 and 113. In this case, further problem is that there is no member which holds the coming-out lever 130 from the outside.

Since the projection 136 projects in a direction intersecting with the lateral plate 131 of the lever 130, there is another problem that the height of the entire connector must be increased by the height of the projection 136.

The present invention has been achieved in view of the above circumstances, it is an object of the invention to provide a lever fitting type connector capable of preventing a lever from coming out and to reduce the height of the connector.

A first aspect of the present invention provides a lever fitting type connector comprising a first connector having a first hood and an engaging unit formed on an outer surface of the first hood; a second connector having a connector body fitted into the first connector, a second hood which covers the first hood; and a lever rotatably provided inside of the second hood such that the lever can turn in a plane parallel to a fitting direction of the connector in order to fit and separate the first connector and the second connector to and from each other by turn of the lever. The lever includes a lateral plate which is in parallel to a turning direction of the lever and which is rotatably engaged with a boss projecting from an inner surface of the second hood. The lateral plate is provided with a drive part within a thickness range of the lateral plate at a position away from a fulcrum of the lever. An outer surface of the first hood of the first connector is provided with an engaging unit which transmits a fitting force and a separating force generated by turn of the lever to the first connector, when the drive part of the lever engages at the time of fitting of the connectors.

According to the above configuration, a force in the fitting direction and a force in the separating direction is applied to the first connector by turning the lever, it is possible to moderate the generation of a stress in the twisting direction in the lever, and it is possible to prevent the lever from coming out from the boss. Providing the lever inside of the second hood can also prevent the lever from coming out. Since the drive part is within the thickness range of the lateral plate, the drive part does not project as the projection. Therefore, when parts are stacked and assembled, the height of the entire connector can be reduced, and the connector can be formed compact. Further, a bending amount of the hood and the like is small when the lever is assembled in the female hood on the side of the female connector, consequently it is easy to assemble the connector.

In the above configuration, a double wall configuration unit comprising inner and outer walls may be provided on a rear end of the second hood in the fitting direction of the connectors so that a tip end of the lateral plate of the lever is inserted into a gap between the inner and the outer walls. Columns connecting the inner wall and the outer wall are located on both sides of the boss as viewed from an insertion direction of the lever. A hole formed in the tip end of the lever may be engaged with the boss with insertion of the lever through a space between the columns. The drive part may be disposed closer to the tip end of the lever than the hole which engages the boss.

According to the above configuration, it is possible to prevent the lever from coming out due to unintentionally bending of a portion of the inner or outer walls around the boss when the lever is turned.

In the above configuration, the lever fitting type connector may further comprise, a fitting engagement projection to receive a fitting force from the drive part of the lever when the connectors are fitted to each other, a separating engagement projection to receive a separating force from the drive part when the connectors are separated from each other, and the lever provided with a guiding groove in the edge thereof. The guiding groove of the lever engages one column provided on the second hood when the lever is turned in the fitting or separating direction, thereby guiding the drive part in a direction intersecting with the fitting direction of the connectors such that the drive part enters into or comes out from a space between the fitting engagement projection and the separating engagement projection.

According to the above configuration, guidance of the lever is assisted by the column which supports the double wall configuration unit. In other words, the column is used as a member to restrict a turn of the lever by engaging with an end of the guiding groove. The turning motion of the lever is restricted by the engagement between the column and the guiding groove of the lever. Accordingly, two bosses; a guiding boss and a turning-restriction boss are not required, and it is only necessary to provide one boss for supporting the turning motion of the lever. Therefore, a distance between the columns disposed on opposite sides of the one boss can be shortened, and it is possible to prevent the female hood from opening.

DETAILED DESCRIPTION OF THE PREFERRED EMBODIMENT

An embodiment of the present invention will be explained below with reference to the drawings.

As shown in FIGS. 8 to 11, a lever fitting type connector according to the embodiment includes a male connector (a first connector) 10 having a male hood (a first hood) 10F, a female connector (a second connector) 20 having a female connector main body (a connector main body) 20A fitted into the male hood 10F, a lever 30 which is rotatably provided on the female connector 20, and which turns to fit and separate the male connector 10 and the female connector 20 to and from each other, and a female hood (a second hood) 40 in which, if a female connector main body 20A is incorporated inside, the female hood 40 is disposed outside of the female connector main body 20A and the female hood (the second hood) 40 covers an outer side of the male hood 10F in the fitting state of the female connector main body 20A into the male hood 10F.

Figure 1:
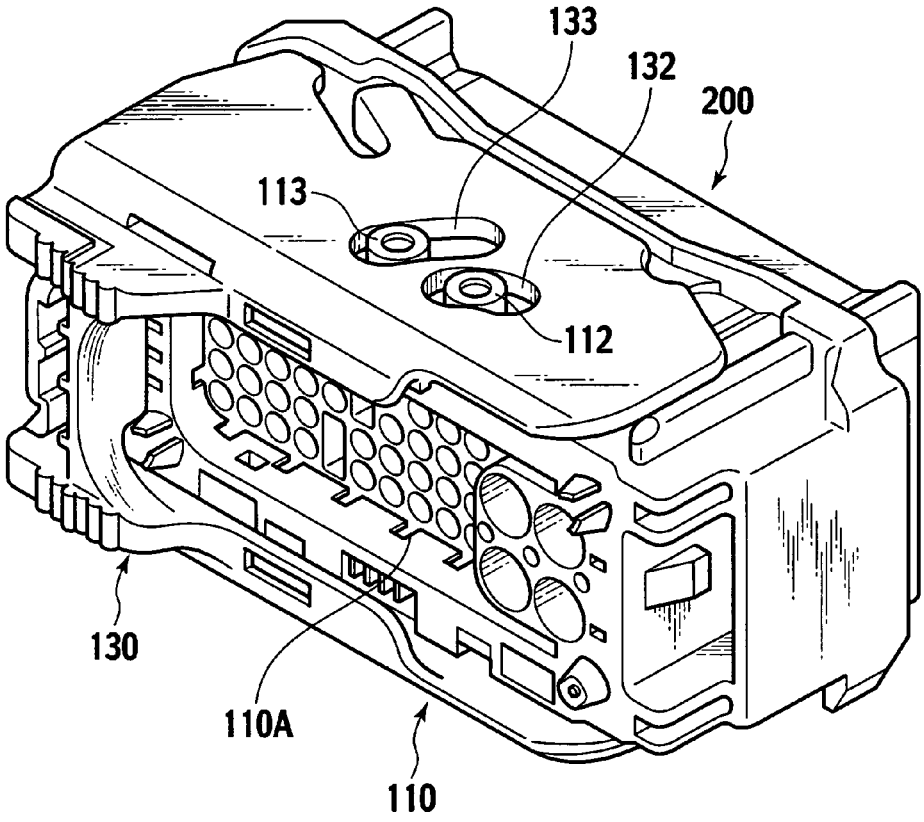
FIG. 1 is a perspective view of a conventional lever fitting type connector.
Figure 2:
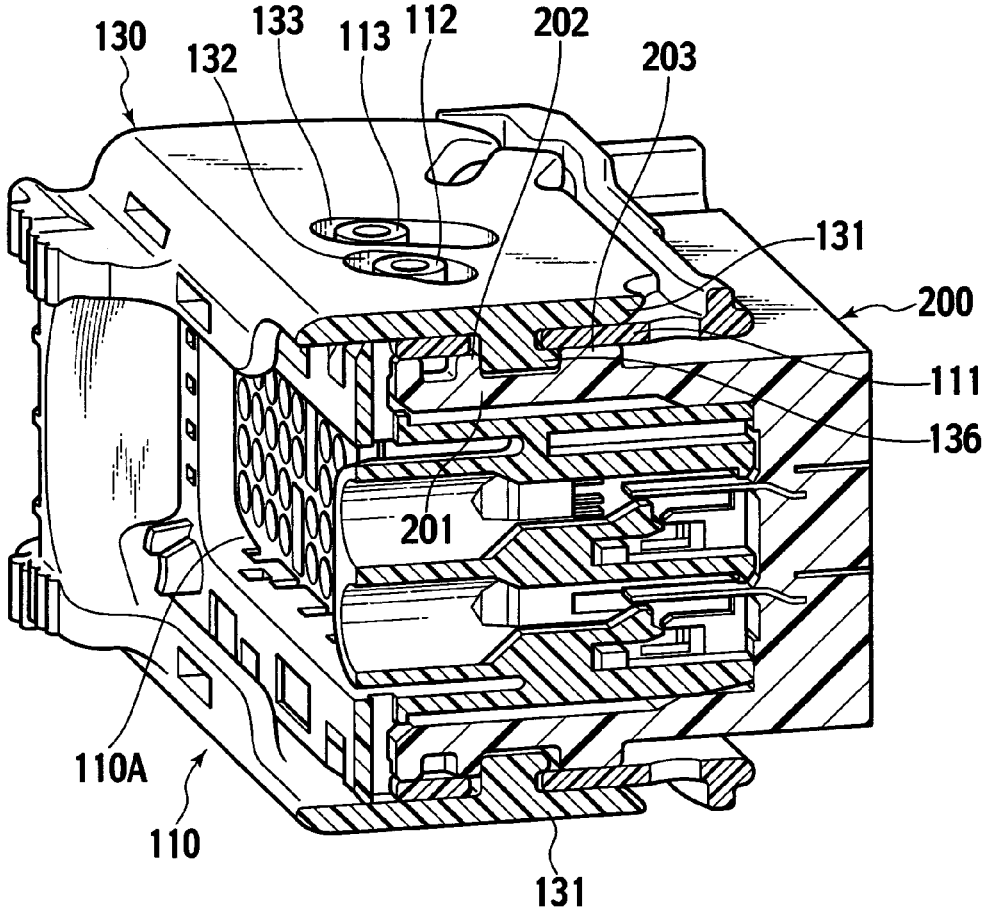
FIG. 2 is a sectional view of the connector as viewed from another angle.
Figure 3:
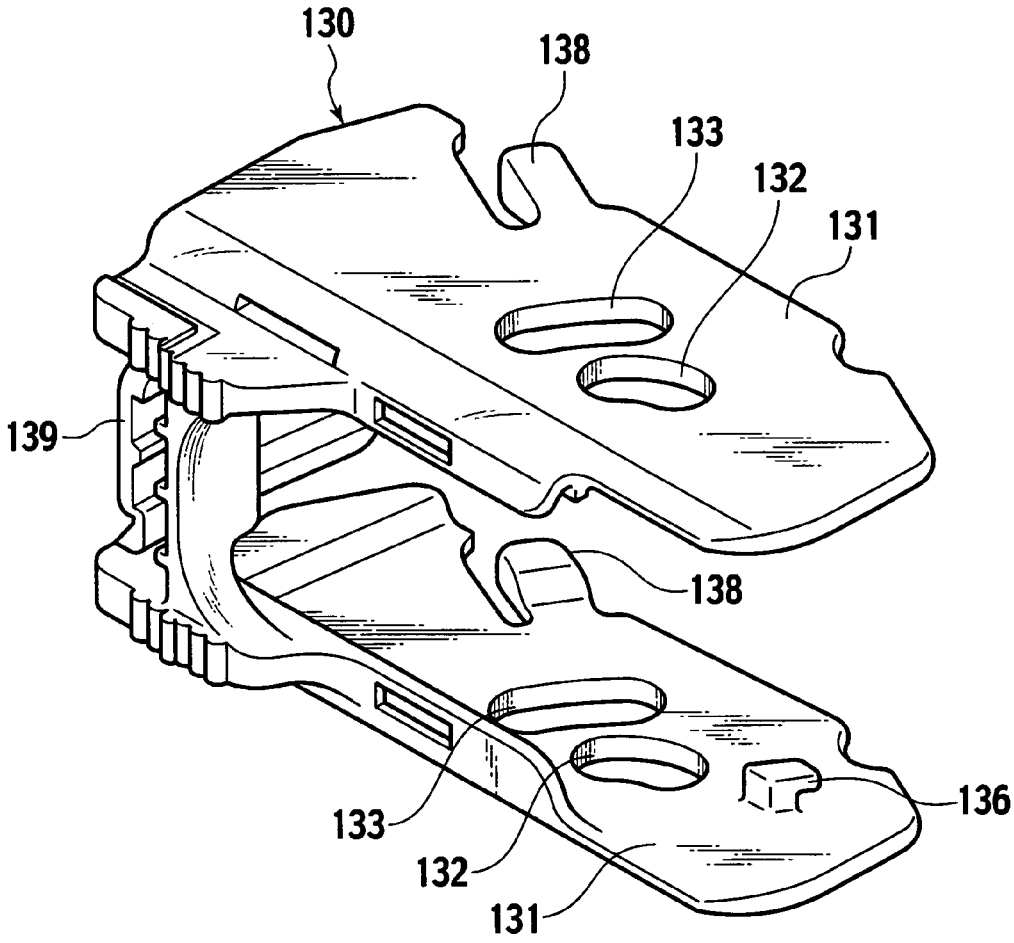
FIG. 3 is a perspective view of the connector from which a lever thereof is removed.
Figure 4:
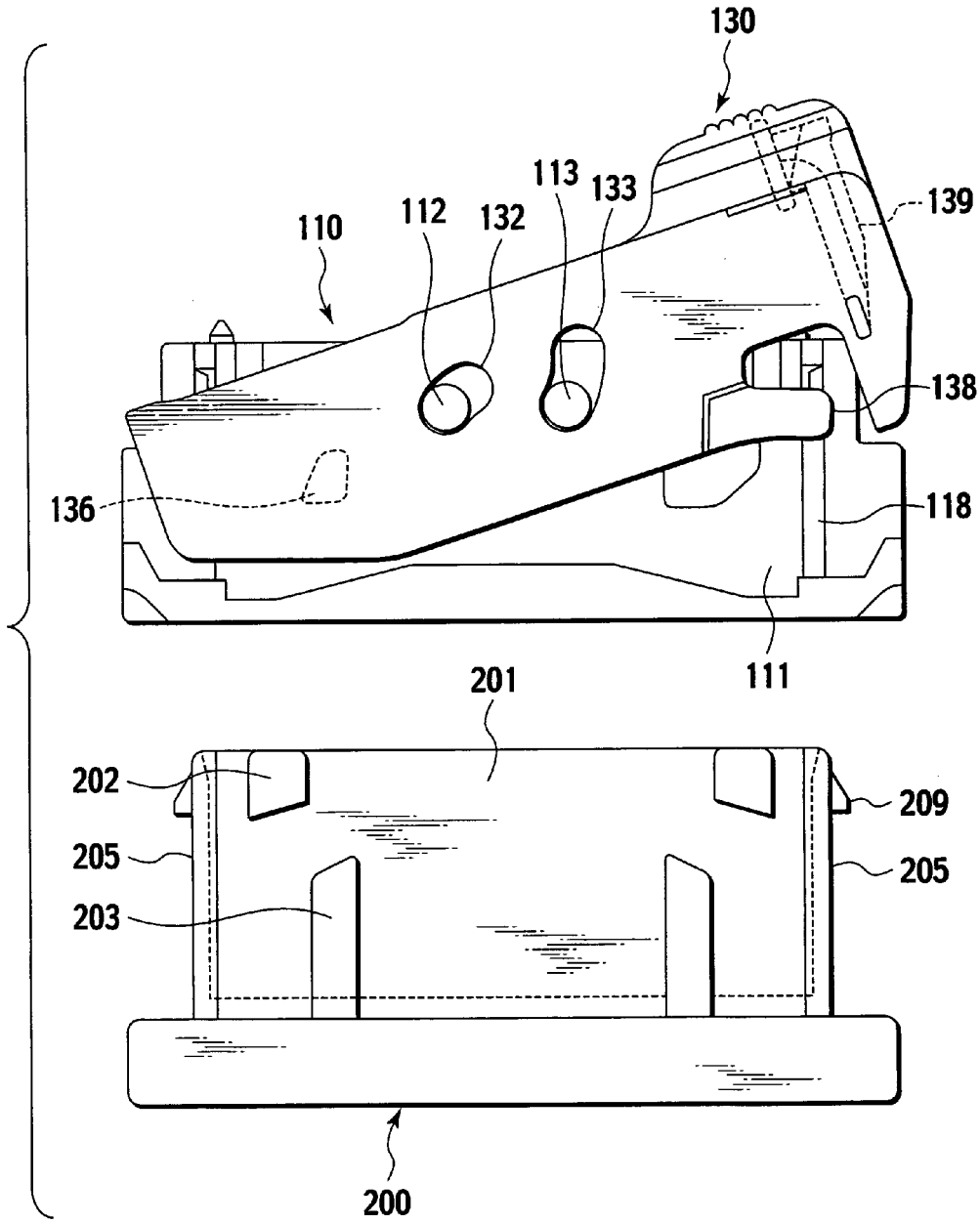
FIG. 4 is a diagram for explaining a fitting motion of the connector, and is a plan view showing an initial non-fitted state.
Figure 5:
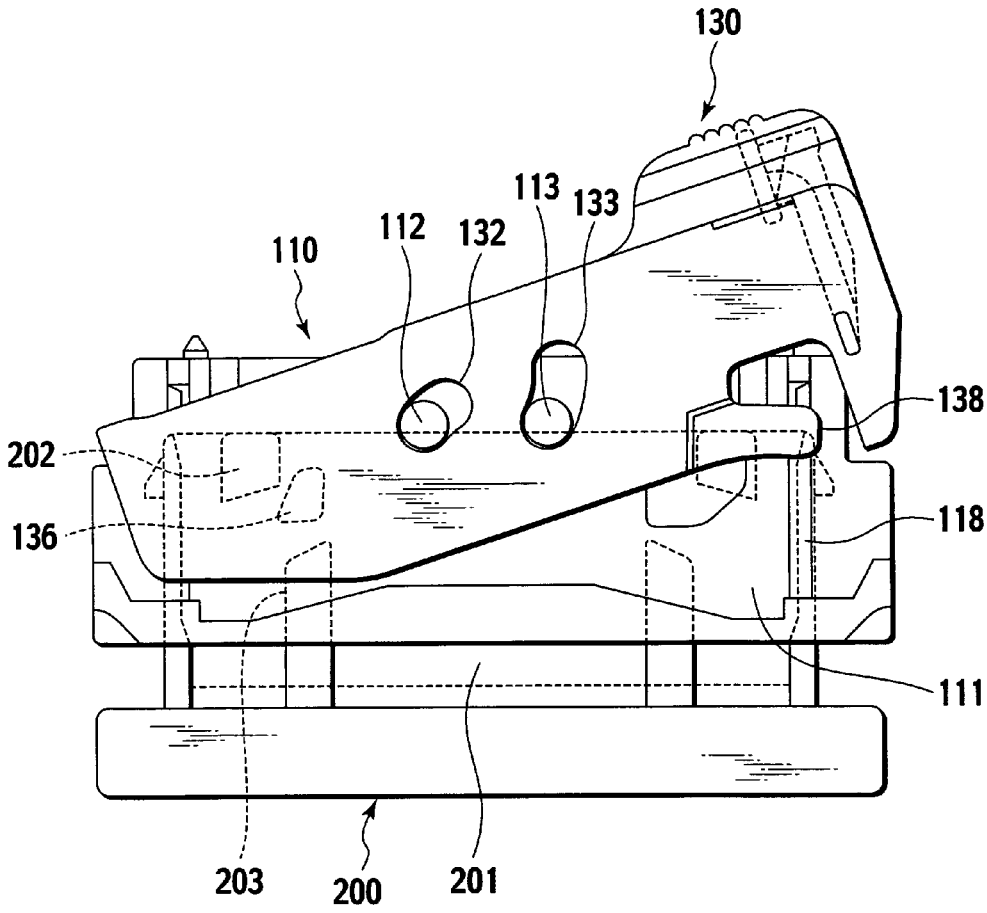
FIG. 5 is a plan view showing a next stage of FIG. 4.
Figure 6:
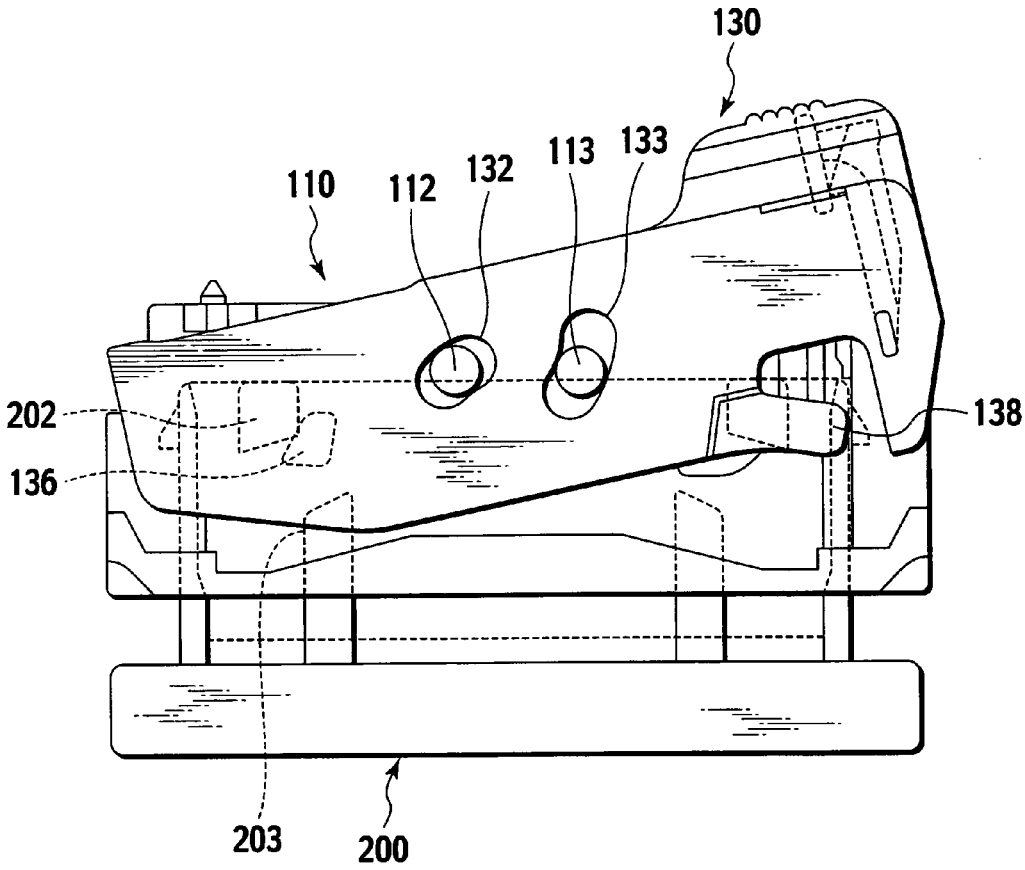
FIG. 6 is a plan view showing a next stage of FIG. 5.
Figure 7:
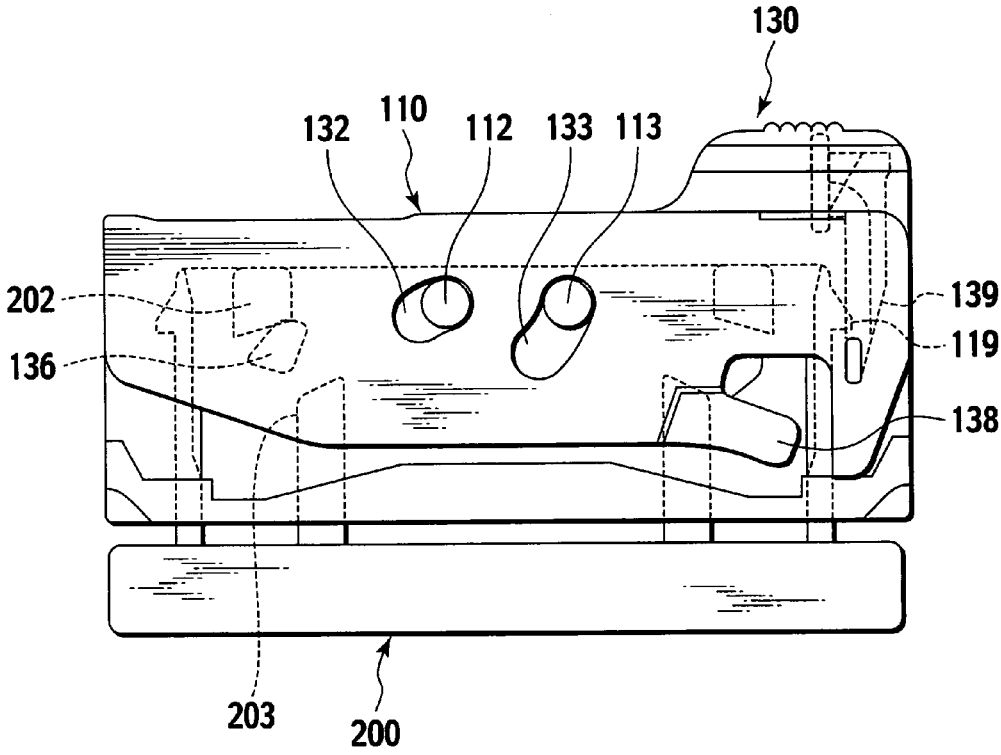
FIG. 7 is a plan view showing a next stage (a fitting state) of FIG. 6.
Figure 8:
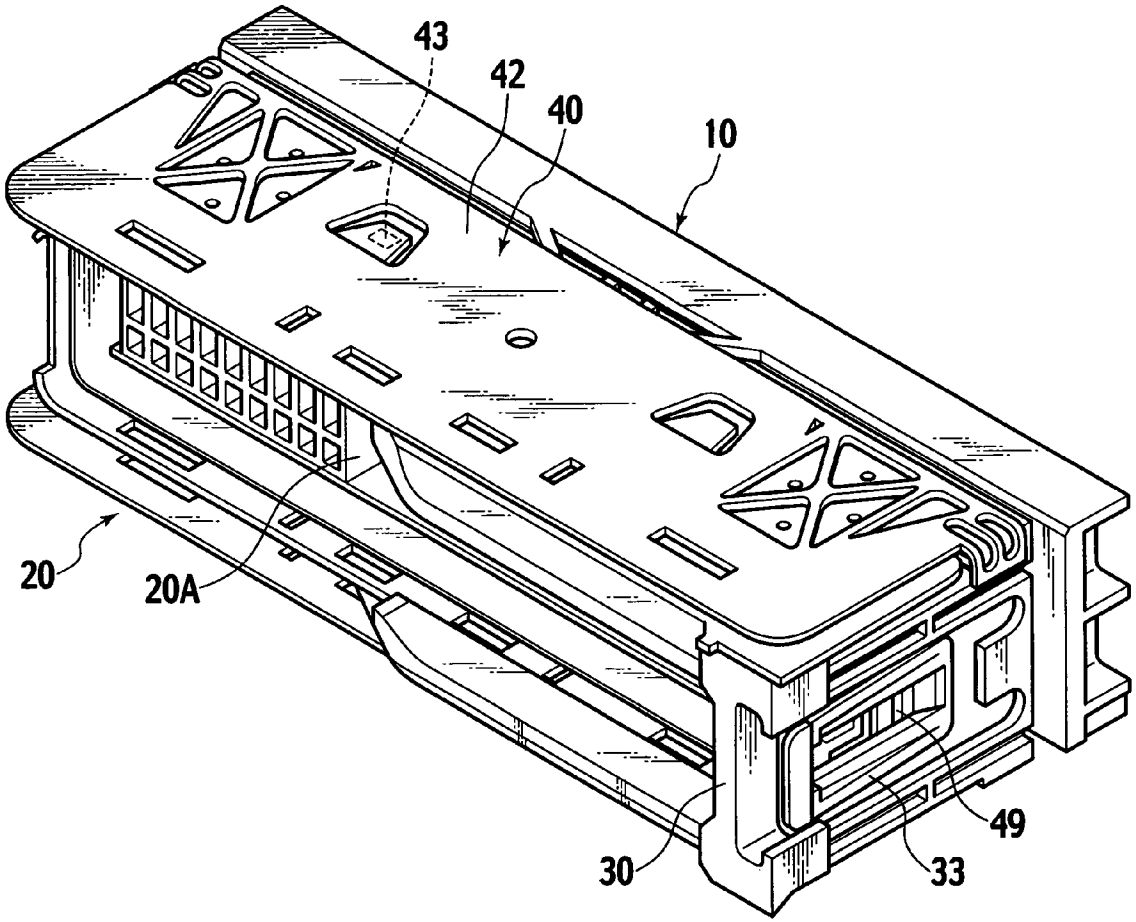
FIG. 8 is a perspective view showing a fitting state of a lever fitting type connector according to an embodiment of the present invention.
Figure 9:
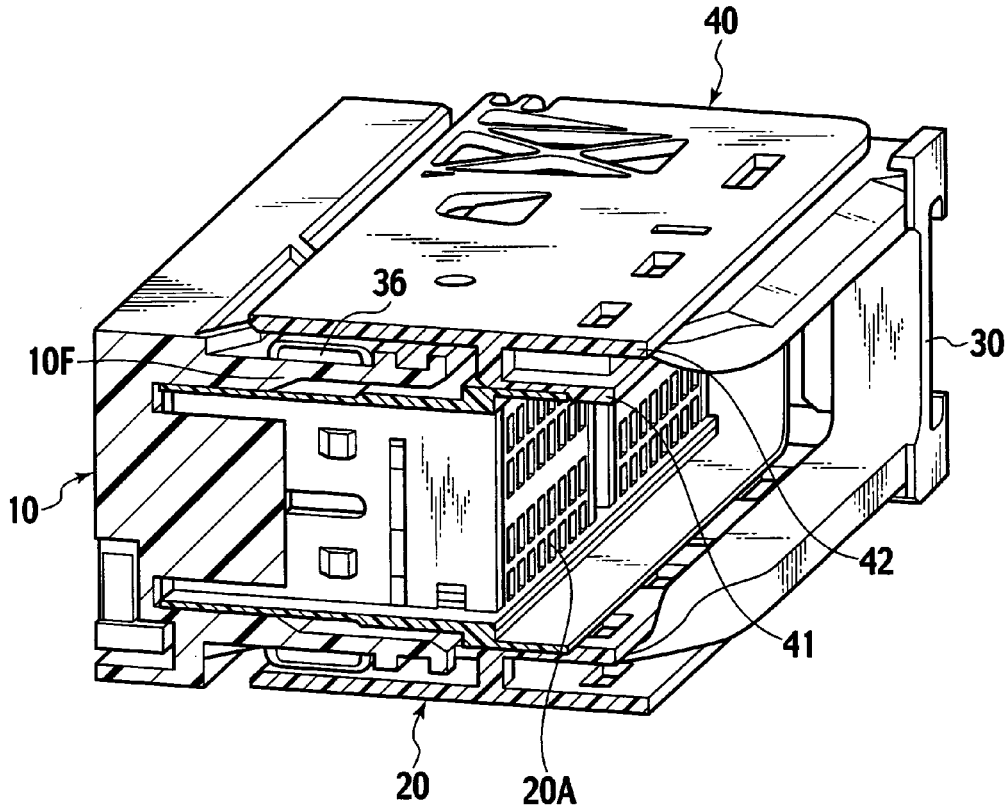
FIG. 9 is a sectional view of the connector as viewed from another angle.
Figure 10:
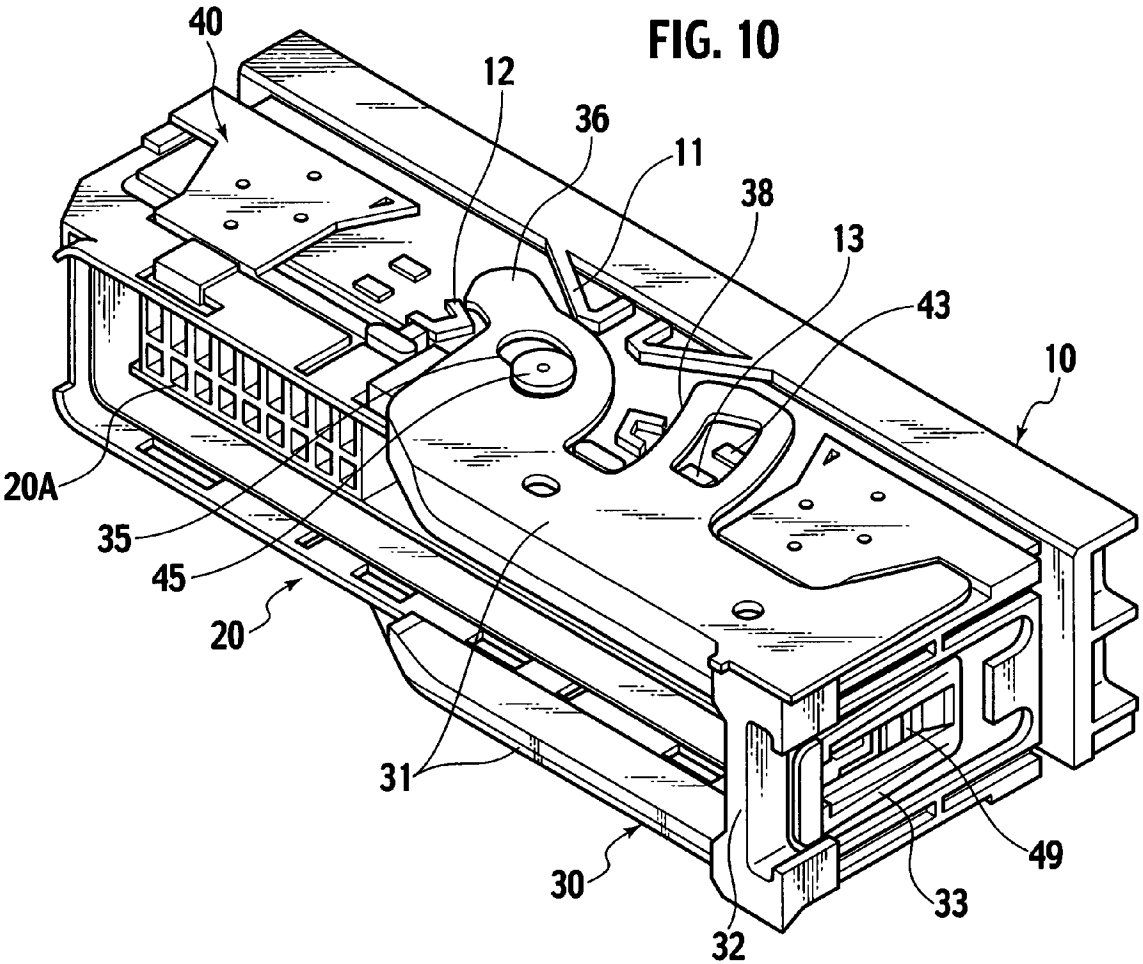
FIG. 10 is a perspective view of the connector from which an upper layer portion of a female hood is cut off so that a lever-assembling portion can be viewed.
Figure 11:
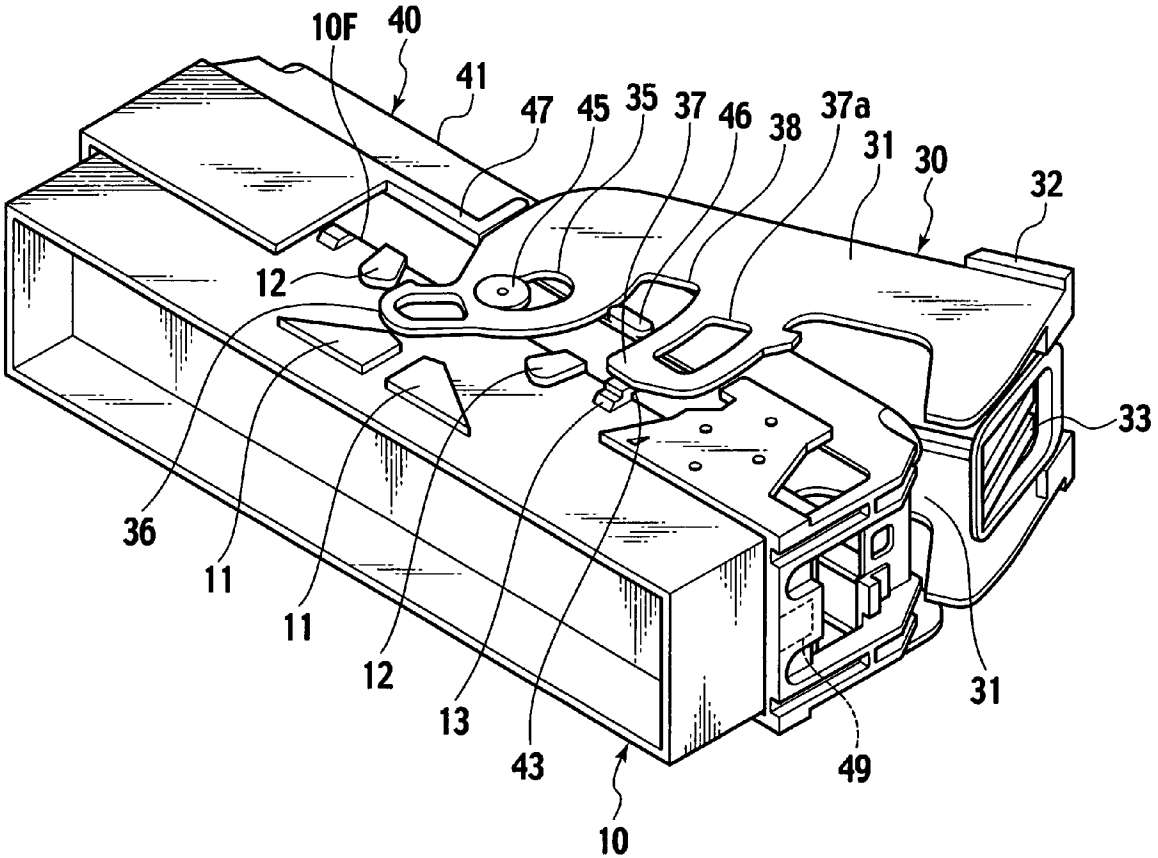
FIG. 11 is a perspective view thereof from which a relationship between the female hood, a male hood and the lever is focused.

The lever 30 includes a pair of lateral plates 31 which are rotatably engaged with a boss 45 projecting from an inner surface of the female hood 40 in parallel to the turning direction of the lever 30, and an operating unit 32 which connects one ends of the lateral plates 31 to each other. As shown in FIG. 9, a rear end of the female hood 40 in the fitting direction of the connectors is provided with a double wall configuration unit comprising an inner wall 41 and an outer wall 42. As shown in FIGS. 10 and 11, tip ends of the lateral plates 31 of the lever 30 are inserted into a gap between the inner wall 41 and the outer wall 42 of the double wall configuration unit. A long hole 35 formed in a tip end of the lever 30 is engaged with the boss 45 through columns 46 and 47 which connect the outer surface wall 42 and the inner surface wall 41 with each other. The columns 46 and 47 are located on opposite sides of the boss 45 as viewed from the insertion direction of the lever 30.

The lateral plate 31 is provided with a drive part 36 on a tip end side from a fulcrum (corresponding to the boss 45 and the hole 35) of the lever 30. The drive part 36 transmits a fitting force and a separating force caused by the operation of the lever 30 to the mating connector. The drive part 36 in this case is provided within a thickness range of the lateral plate 31 of the lever 30.

Meanwhile, an outer surface of the male hood 10F of the male connector 10 is provided with two engagement projections (engaging units) 11 and 12 which engage the drive part 36 of the lever 30 at the time of fitting of the connectors to transmit a fitting force and a separating force generated by the turning operation of the lever 30 to the male connector 10. The engagement projection 12 is a fitting engagement projection which receives the fitting force from the drive part 36 of the lever 30 when the connectors are fitted to each other, and the engagement projection 11 is a separating engagement projection which receives the separating force from the drive part 36 of the lever 30 when the connectors are separated from each other.

The lever 30 is provided at its outer peripheral edge with a guiding groove 38 which engages the column 46 provided on the female hood 40 when the lever 30 is turned in the fitting direction, thereby guiding the drive part 36 of the tip end of the lever 30 in a direction intersecting with the fitting direction of the connectors such that the drive part 36 enters between the fitting engagement projection 12 of the mating connector (the male connector 10) and the separating engagement projection 11, and which engages the column 46 when the lever 30 is turned in the separating direction, thereby guiding the drive part 36 in a direction intersecting with the fitting direction of the connectors so that the drive part 36 can comes out from between the fitting engagement projection 12 and the separating engagement projection 11. The guiding groove 38 and the column 46 also function as restricting units for restricting the turning angle of the lever 30. That is, an end of the guiding groove 38 abuts against the column 46, so that the lever 30 does not turn further.

An arm 37 having a window 37*a* is provided adjacent to the guiding groove 38 of the lever 30. The arm 37 temporarily engages a projection 43 provided on an inner surface of the female hood 40, thereby temporarily retaining the lever 30 at a position as shown in FIG. 11. In the initial stage of fitting between the connectors, the projection 43 rides over a projection 13 on the side of the male hood 10F, and the temporarily retained state of the lever 30 is released. The window 37*a* accommodates the projection 43 and the projection 13 when the lever 30 turns to a final position for engaging.

The lever 30 and the female hood 40 are provided with lock means 33 and 49 for locking the lever 30 in a state where the lever 30 is turned and the connectors are fitted to each other.

An operation thereof will be explained next.

Figure 12:
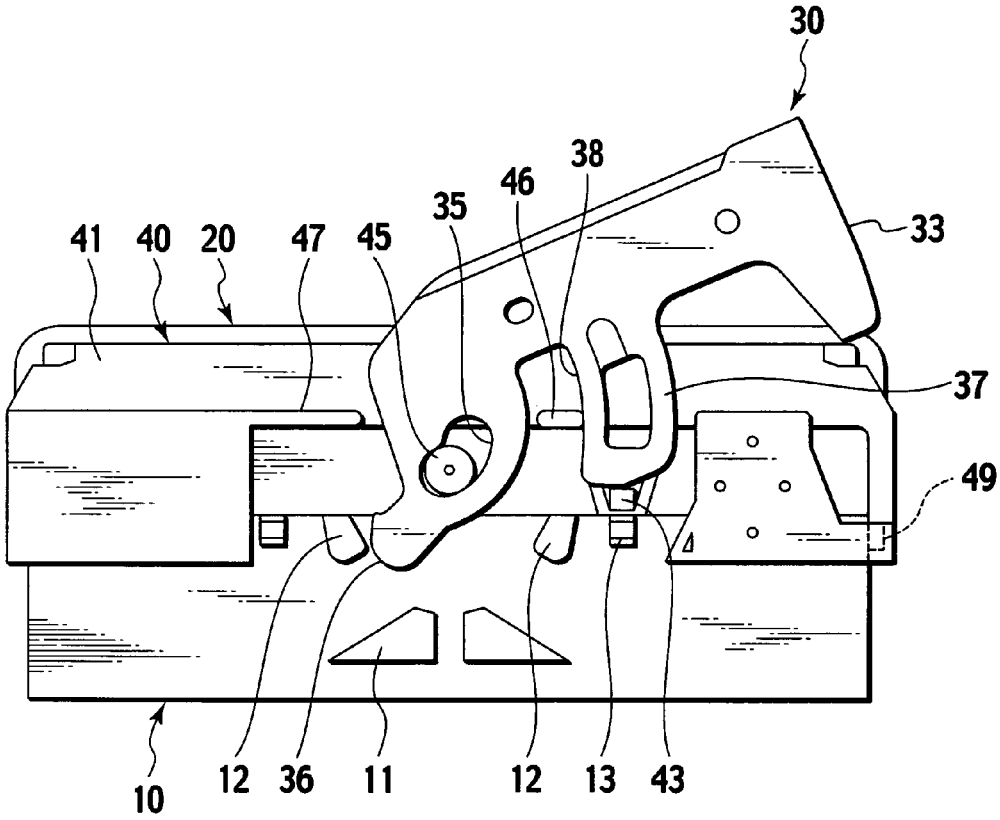
FIG. 12 is a diagram for explaining a fitting motion of the connector, and is a plan view showing an initial non-fitted state.

As shown in FIG. 12, the lever 30 is held at the temporarily retained position before the male and female connectors 10 and 20 are fitted to each other. In order to fit the male and female connectors 10 and 20 to each other from this state, the male and female connectors 10 and 20 are opposed to each other and inserted. In this state, the temporarily retained state is released and the lever 30 can turn.

Figure 13:
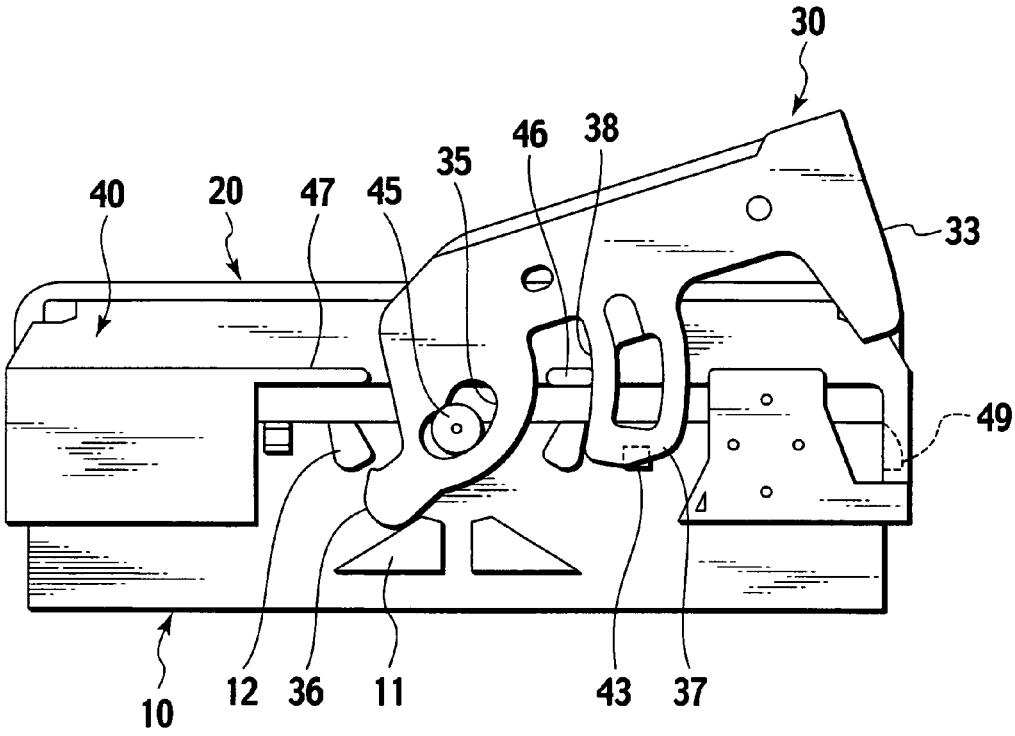
FIG. 13 is a plan view showing a next stage of FIG. 12.

A force is then applied to the operating unit 32 to turn the lever 30 in the fitting direction. With this action, the lever 30 slides in a direction intersecting with the fitting direction of the connectors, i.e., in the longitudinal direction of the female connector 20 by the guiding effect by the column 46 and the guiding groove 38. As shown in FIG. 13, the drive part 36 of the lever 30 enters between the two engagement projections 11 and 12 on the side of the male connector 10.

Figure 14:
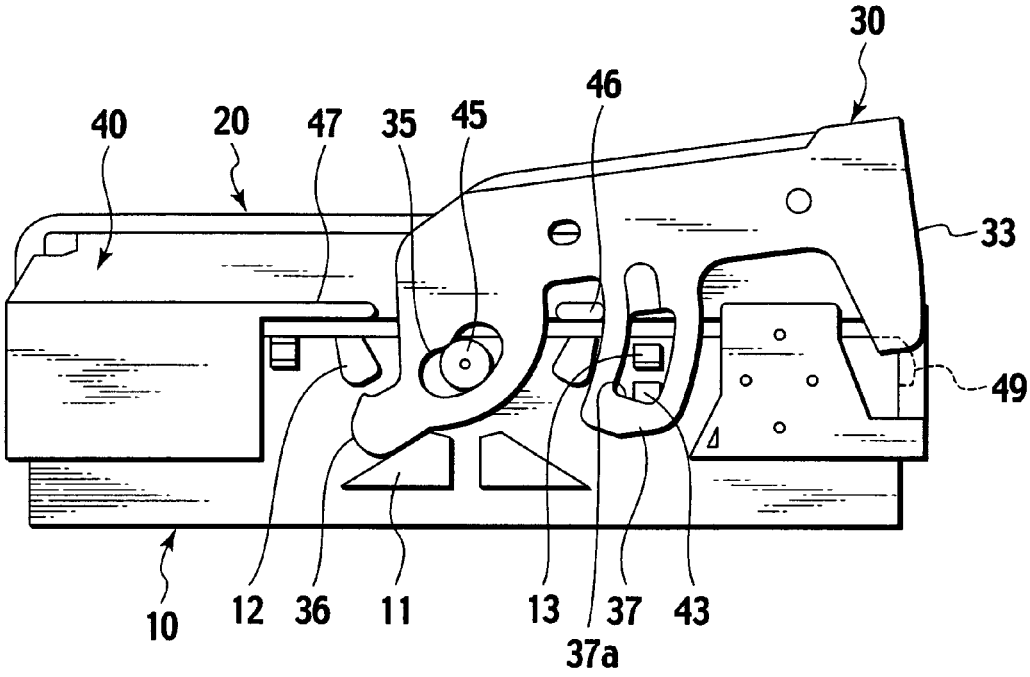
FIG. 14 is a plan view showing a next stage of FIG. 13.
Figure 15:
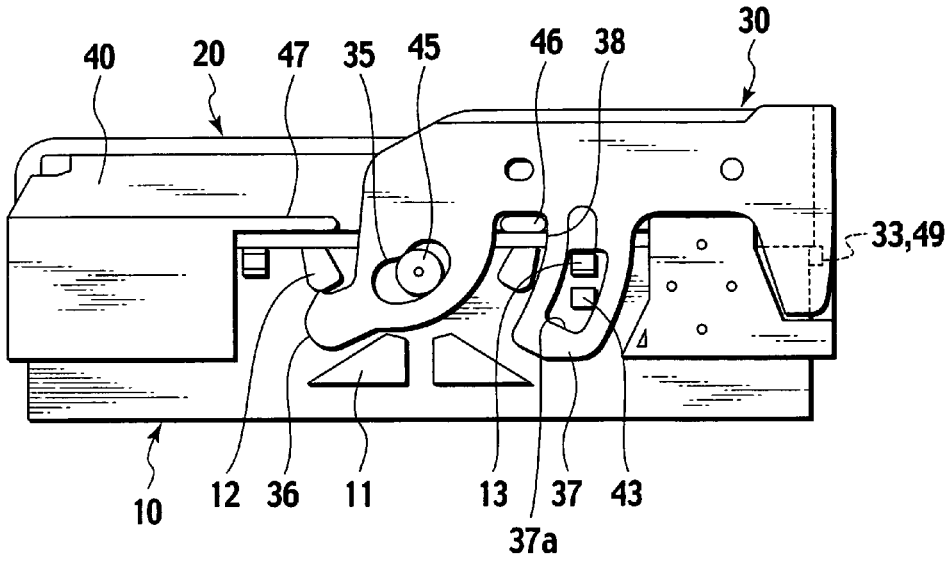
FIG. 15 is a plan view showing a next stage (a fitting state) of FIG. 14.

If the lever 30 is further turned, as shown in FIGS. 14 and 15, the drive part 36 and the fitting engagement projection 12 are engaged with each other, the fitting force caused by the lever 30 is transmitted from the fitting engagement projection 12 to the male connector 10 by the effect of the lever, and the male connector 10 is fitted into the female connector 20. In this connector fitting state, the lever 30 is turned to the final position, the lock means 33 and 49 engage each other, and the lever 30 is locked.

Meanwhile, to release the fitted state of the male and female connectors 10 and 20, locking of the lever 30 is first released and the lever 30 is turned in the opposite direction. With this configuration, the drive part 36 of the tip end of the lever 30 engages the separating engagement projection 11 on the side of the male connector 10, the lever 30 further turns, the separating force caused by the lever 30 is transmitted from the separating engagement projection 11 to the male connector 10 by the effect of the lever, and the male and female connectors 10 and 20 are separated from each other. If the lever 30 is further turned, the lever 30 slides and returns to the initial position by the guiding effect of the column 46 and the guiding groove 38, and the lever 30 is again temporarily retained.

According to the lever fitting type connector with such a configuration, since the drive part 36 is provided in the thickness range of the lateral plate 31 which is in parallel to the turning plane of the lever 30, when a force in the fitting direction or a force in the separating direction is applied to the male connector 10 by turning the lever 30, it is possible to moderate the generation of a stress in the twisting direction in the lever 30, and it is possible to prevent the lever 30 from coming out from the boss 35.

The lever 30 is provided inside of the female hood 40, and a member (the female hood 40) which prevents the lever 30 from coming out exists outside of the lever 30. Therefore, this configuration also prevents the lever 30 from coming out. The drive part 36 does not exist on the lateral plate 31 of the lever 30 as a projection. Therefore, when parts are stacked and assembled, the height of the entire connector can be reduced, and the connector can be formed compact.

Since the drive part 36 does not project from the lateral plate 31, a bending amount of the hood 40 and the like is small when the lever 30 is assembled in the female hood 40 on the side of the female connector 20, and it is easy to assemble the connector.

Figure 16:
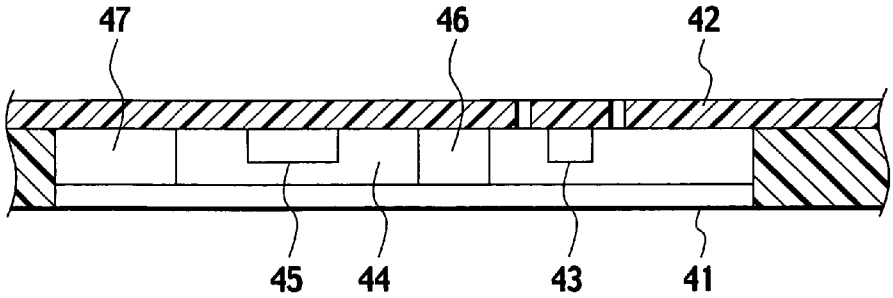
FIG. 16 is a sectional view showing a relationship between a boss and a column provided on the female hood.

Further, as shown in FIG. 16, the boss 35 that rotatably supports the lever 30 is disposed between the columns 46 and 47 which support the double wall configuration unit of the female hood 40. Therefore, it is possible to avoid a case where a portion provided with the boss 35 is unintentionally bent when the lever 30 is turned and the lever 30 comes out from the boss 45.

The lever 30 is not guided by the engagement between the hole 35 formed in the lever 30 and of the boss 45 projecting from the female hood 40, but is guided with utilizing the column 46 which supports the double wall configuration unit of the female hood 40. The turning motion of the lever 30 is restricted by the engagement between the column 46 and the guiding groove 38 of the lever 30. With this configuration, a guiding boss and a turning-restriction boss are not required, and it is only necessary to provide one boss 45 for supporting the turning motion of the lever 30. Therefore, a distance between the columns 46 and 47 disposed on opposite sides of one boss 45 can be shortened, and it is possible to prevent the female hood 40 from opening.

What is claimed is:

1. A lever fitting type connector comprising:

a first connector including:

a first hood, an engaging unit formed on an outer surface of the first hood;

a second connector fitted to the first connector, the second connector including:

a connector main body fitted into the first hood, a second hood covering the first hood and provided with a boss projecting from an inner surface of the second hood, a lever with a lateral plate rotatably provided inside the second hood, the lateral plate formed in parallel to a turning direction of the lever and engaged with the boss, a drive part formed in the lateral plate within a thickness range thereof at a position away from a fulcrum of the lever;

wherein the lever turns in a plane parallel to a fitting direction of the connector to fit or to separate the first connector into or from the second connector, wherein the engaging unit transmits a fitting or a separating force generated by turn of the lever from the drive part to the first connector to fit or to separate the first connector into or from the second connector.

2. The lever fitting type connector according to claim 1, wherein a double wall configuration unit formed with inner and outer walls is provided on a rear end of the second hood in the fitting direction of the connectors;

wherein a tip end of the lateral plate of the lever is inserted into a gap between the inner and the outer surface walls of the double wall configuration unit;

wherein a hole formed in the tip end of the lever is engaged with the boss with insertion of the lever through a space between columns connected to the inner and the outer walls; and wherein the drive part is disposed closer to the tip end of the lever than the hole which engages the boss.

3. The lever fitting type connector according to claim 2, further comprising, a fitting engagement projection provided on the first connector to receive a fitting force from the drive part of the lever, and a separating engagement projection provided on the first connector to receive a separating force from the drive part of the lever, wherein an outer peripheral edge of the lever is provided with a groove;

wherein the groove engages one column provided on the second hood to guide the drive part into a space between the fitting engagement projection and the separating engagement projection, further the groove engages the column to enable the drive part to come out from between the fitting engagement projection and the separating engagement projection;

wherein the column is also used as a member to restrict a turn of the lever by engaging to an end of the groove.

* * * * *